US006216931B1

(12) United States Patent
Trawinski

(10) Patent No.: US 6,216,931 B1
(45) Date of Patent: Apr. 17, 2001

(54) COMBINED WORK-BELT AND TOOL STORAGE SYSTEM

(76) Inventor: Matthew Trawinski, 127 Forest Pl., Rochel Park, NJ (US) 07662

( * ) Notice: Subject to any disclaimer, the term of this patent is extended or adjusted under 35 U.S.C. 154(b) by 0 days.

(21) Appl. No.: 09/358,467

(22) Filed: Jul. 22, 1999

(51) Int. Cl.[7] ..... A45F 4/00

(52) U.S. Cl. ..... 224/583; 224/255; 224/268; 224/269; 224/665; 224/682; 224/904

(58) Field of Search ..... 116/222; 182/3; 211/59.1; 224/151, 673, 148, 666, 682, 683, 582, 583, 255, 269, 904, 268, 665, 680; 248/220.21, 223

(56) References Cited

U.S. PATENT DOCUMENTS

| | | | | |
|---|---|---|---|---|
| 1,290,404 | * | 1/1919 | Stuart | 224/666 |
| 2,945,614 | * | 7/1960 | Wittmann, Sr. | 224/666 |
| 3,645,485 | * | 2/1972 | Gold | 248/223 |
| 3,799,357 | * | 3/1974 | Govang | 211/59 |
| 4,953,765 | * | 9/1990 | Little et al. | 224/151 |
| 5,438,950 | * | 8/1995 | Rodrigues | 116/222 |
| 5,489,051 | * | 2/1996 | Robinson | 224/148 |
| 5,501,379 | * | 3/1996 | Munoz | 224/240 |
| 5,915,610 | * | 6/1999 | Russell | 224/673 |
| 5,957,421 | * | 9/1999 | Barbour | 248/220.21 |
| 5,988,315 | * | 11/1999 | Crane | 182/3 |

FOREIGN PATENT DOCUMENTS

| | | | | |
|---|---|---|---|---|
| 975535 | * | 3/1951 | (FR) | 224/252 |

* cited by examiner

*Primary Examiner*—Allan N. Shoap
*Assistant Examiner*—Joe Merek
(74) *Attorney, Agent, or Firm*—Siemens Patent Services, LC.

(57) ABSTRACT

A combined work-belt with detachable pouches for holding small tools and supplies, and an organizing pouch storage unit. The work-belt is made from strong, flexible material and includes a plurality of apertures with grommets extending along its length. Each of the pouches has two heavy duty metal hooks for supporting the pouch on two of the apertures. The organizing pouch storage unit also contains a plurality of apertures for accepting the hooks of the pouches. Each of the pouches has a storage location on the unit with indicia provided to indicate the contents of the pouch normally stored at that location. The pouches are provided in various shapes and sizes for holding hardware, tools or supplies and include two apertures along their bottom edge, for consecutively attaching another pouch to the bottom of the first pouch. This consecutive attachment can be repeated several times such that a plurality of pouches is suspended from a single pouch location on either the storage unit or the work-belt. The work-belt may include suspenders for additional support.

11 Claims, 3 Drawing Sheets

COMBINED WORK-BELT AND TOOL STORAGE SYSTEM

BACKGROUND OF THE INVENTION

1. Field of the Invention

The present invention relates generally to small tool storage and carrying systems. More specifically, the invention comprises a combined work-belt with detachable pouches for holding small tools and supplies, and an organizing pouch storage unit.

2. Description of the Prior Art

Work-belts with detachable holders for supporting different tools and supplies on the belt are known. In addition, tool storage systems such as peg boards are also known. What is lacking in the prior art is a tool storage system having a plurality of pouches that are attachable to a work-belt or to a specific storage location on a pouch storage unit. In this manner, the present invention allows a user to select the tools and supplies needed for a specific job, remove the pouches containing these articles from the pouch storage unit, and attach the pouches to their work-belt.

U.S. Pat. No. 920,413, issued to Batchelder on May 4, 1909, discloses a cartridge belt or bandoleer. Cartridge pouches are removably attached to the belt using a loop and clip system. Detachable suspenders are also provided to support the belt. There is no provision for attaching a second pouch to a pouch directly connected to the belt. In addition, this reference does not contain a system or method for storing and/or organizing the pouches as does the present invention.

A personal webbing system is detailed in U.S. Pat. No. 4,676,419, issued to Victor on Jun. 30, 1987. The system uses a series of hooks and apertures to attach various items to a belt. Velcro fasteners are used to secure the connection by maintaining the hooks in the apertures. The apertures include reinforcement grommets, and a removable support strap connects a shoulder yoke to the belt. Means for attaching the items to each other or for organizing the items while they are not attached to the belt, are not disclosed.

U.S. Pat. No. 4,819,846, issued to Hannemann on Apr. 11, 1989, is drawn to a sportsman's belt having a plurality of pockets. The pockets are removably attached to the belt using hook and loop fastener material such as Velcro. Velcro is also used to hold the ends of the belt together. There is no arrangement to attach the pockets to one another, or to organize the pockets when they are not in use.

A horse grooming organizer is disclosed in U.S. Pat. No. 4,953,765, issued to Little et al. on Sep. 4, 1990. The organizer includes a rectangular panel member having detachably secured pouches thereon. The pouches have labels indicating the horse grooming items contained within. The pouches having the desired items are removed from the panel and removably attached to an apron. Hook and loop fasteners are used to attach the pouches to the panel or apron. There is no disclosure or suggestion to attach the pouches to one another for consecutive support. In addition, the present invention provides labels for the storage location of the pouches, as opposed to directly labeling the pouches.

U.S. Pat. No. 4,993,614, issued to Bonofiglo on Feb. 19, 1991, discloses a pocket member for a tool belt. Velcro or snaps removably connect one or more of the pocket members to the tool belt. The pocket members are not designed to attach to one another. Furthermore, there is no teaching of organizing the pocket members when they are not on the tool belt.

A janitorial utility belt for carrying spray bottles, gloves, dusters and cleaning towels is detailed in U.S. Pat. No. 5,004,136, issued to Leath on Apr. 2, 1991. The belt has a plurality of rings for attaching pouches to the belt. Loops of material connect the rings to the belt and pouches. A hook member may be alternatively used to connect the rings to the pouches. There is no structure or method for attaching consecutive pouches to one another or for storing the pouches when not in use.

U.S. Pat. No. 5,152,443, issued to Hagan on Oct. 6, 1992, is drawn to a utility belt. The belt includes a variety of different tool holders for items such as a brush, a spray bottle, a rag, and paper towels. Sections can be added to the belt to change the size of the belt. There is no disclosure of sequentially hanging the tool hangers from each other, or storing the tool hangers.

A modular component system is disclosed in U.S. Pat. No. 5,240,156, issued to Sicotte et al. on Aug. 31, 1993. A support member in the form of a belt or vest includes a support surface of looped material. Compartment modules with hook material can be attached to the support surface in any desired position or angular orientation. The compartment modules cannot be attached to one another, nor is a storage system for the modules provided as taught in the present invention.

None of the above inventions and patents, taken either singly or in combination, is seen to describe the instant invention as claimed.

SUMMARY OF THE INVENTION

The present invention comprises a combined work-belt with detachable pouches for holding small tools and supplies, and an organizing pouch storage unit. The heavy duty work-belt is formed with a plurality of apertures (for accepting hooks on the pouches) extending substantially along the entire length of the work-belt. Optional suspenders are used when a large number of pouches or heavy pouches are attached to the belt. The belt is made from leather or other suitably strong, flexible material used to make heavy duty belts. The apertures preferably have grommets to increase their strength.

The organizing pouch storage unit also contains a plurality of apertures for supporting the hooks of the pouches. Each of the pouches has a separate and specific storage location on the unit. Indicia is provided at each location on the storage unit to indicate the contents of the pouch normally stored at that location. The storage unit may be rigid and in the form of a storage and display board (made of material similar to peg-board). The board can be mounted on the wall of a shop, in a work van or truck, or in a number of other suitable locations. Alternatively, the storage unit may be in the form of a flexible storage unit made of canvas or similar material. The flexible storage unit can be lain on a flat surface (or hung on a wall) to select and return pouches, and can then be rolled up for storing and transporting.

The pouches are provided in various sizes for holding hardware, tools or supplies. To form the pouch, a rectangular piece of leather (or a suitable synthetic material such as plastic) is folded over itself and sewn or otherwise bonded along its sides. The front and back top edges of the piece of material are not bonded together, thereby forming an open pouch or pocket. Each of the pouches has two heavy duty metal hooks for supporting the pouch on two of the apertures on the belt or on the storage unit. The hooks are attached to the back top edge of the pouches. The basic pouch is sized to hold small hardware items such as screws, nails, rivets, electrical connectors, pipe brackets, etc. The hooks on the basic pouch are spaced apart at a distance such that they engage adjacent apertures on either the belt or storage unit.

The basic pouch also has two apertures located along the bottom of the pouch and spaced apart this same distance for attaching another basic pouch "in series" or consecutively to the bottom of the pouch attached directly to the work-belt. This consecutive attachment can be repeated several times such that a plurality of pouches is suspended from a single pouch location on either the storage unit or the work-belt. This not only allows greater flexibility and capacity when using the work-belt, but also provides for several pouches to be hung under a single label on the storage unit. The number of consecutively attached pouches is limited only by the length of the storage unit, or, when mounted on the work-belt, the required freedom of movement on the part of the wearer must be considered. Normally, a maximum of three consecutively attached pouches are used on the work-belt, to keep the contents of the lowest pouch within reach, and to avoid interfering with walking.

A larger pouch for supporting larger hardware or small tools on the work-belt, is also provided. The large pouch is slightly wider than two basic pouches and has two hooks similar to the basic pouch, but spaced further apart for engaging two non-adjacent apertures on the work-belt or storage unit. As with the basic pouch, the large pouch has two apertures located along the bottom of the pouch and spaced apart the appropriate distance for attaching a basic pouch to the bottom of the large pouch. Due to the increased size and weight of the intended contents of the large pouch, they are preferably designed only to be directly attached to the work-belt. For lighter applications, however, the large pouches may have apertures at the bottom thereof that are spaced further apart for supporting a second large pouch in a consecutive fashion as described above.

Custom pouches for supporting specific items on the work-belt are also envisioned. One type of custom pouch is a tape pouch for attaching a roll of adhesive or measuring tape to the work-belt or storage unit. The tape pouch is similar in size and shape to the basic pouch, except for a cut-out section in the front of the pouch. A double hook loops over the top edge of the rear of the pouch and through the center of the roll of tape, to further secure the tape within the pouch. The cut-out section leaves room for the double loop, as well as aiding in removing an encased measuring tape from the pouch (in which case the double hook would not be used). The two hooks on the tape pouch are spaced further apart than the basic pouch, to increase lateral stability.

Accordingly, it is a principal object of the invention to provide a combined work-belt and tool storage system wherein a user can quickly select pouches containing the tools and supplies needed for a job from a pouch storage unit, and can attach these pouches to their work-belt for easy access to the required tools and supplies.

It is another object of the invention to provide a work-belt with a first tool pouch that is supported directly on the work-belt, and a second tool pouch that is supported on the first tool pouch.

It is a further object of the invention to provide a work-belt with small pouches for hardware, large pouches for larger hardware and small tools, and custom pouches for specific items.

It is yet another object of the invention to provide a combined work-belt and tool storage system with a pouch storage unit that can be mounted on a wall to store and display the pouches until the items in the pouches are needed.

It is still yet another object of the invention to provide a combined work-belt and tool storage system with a pouch storage unit that can be rolled-up to store the pouches until the items in the pouches are needed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
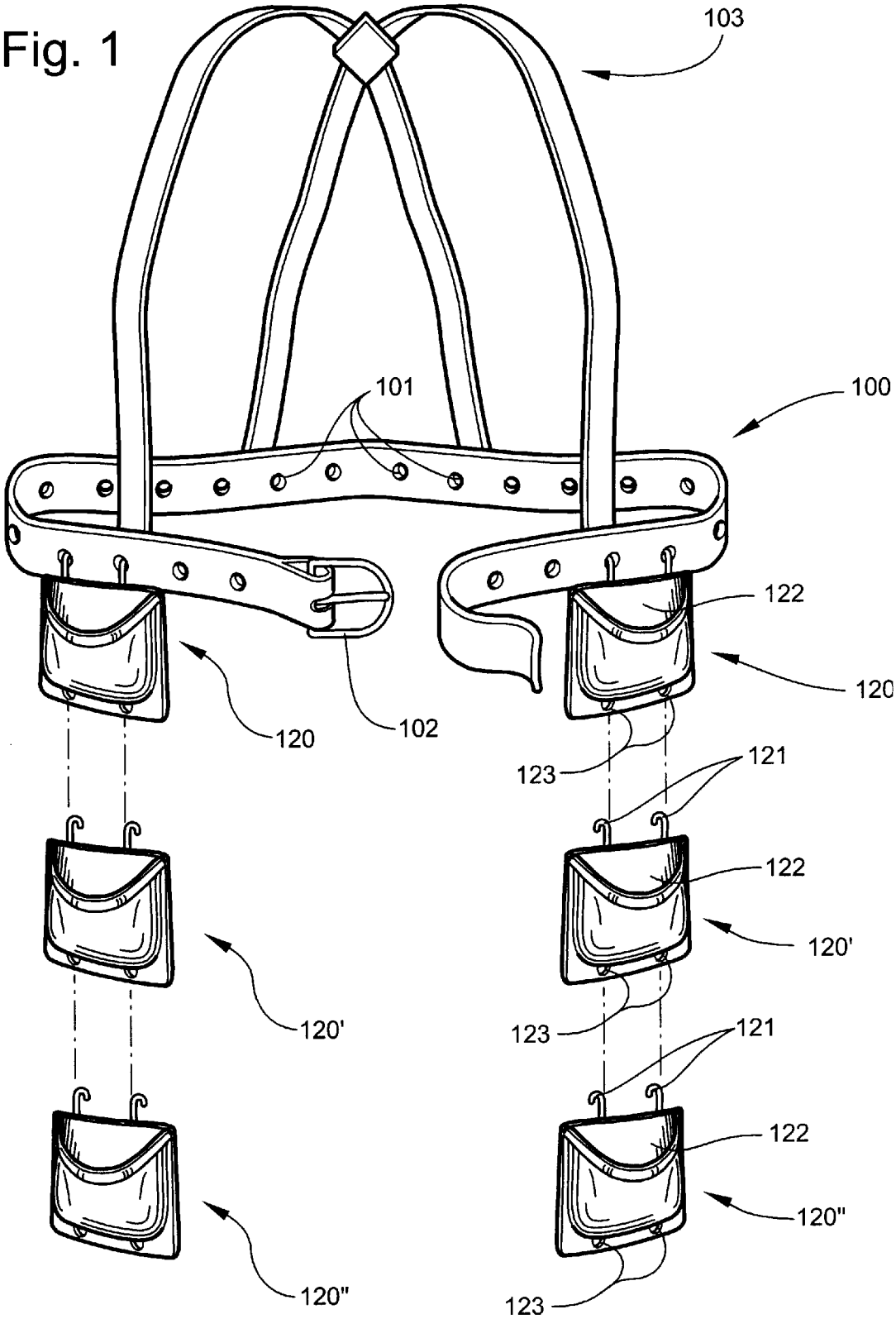
FIG. 1 is an isometric view of the work-belt and several basic pouches of the combined work-belt and tool storage system of the present invention.

In FIG. 1, the work-belt 100 of the present invention is shown with several of the basic pouches 120, 120' and 120", attached thereto. Work-belt 100 is of the heavy duty variety and includes a plurality of apertures 101 spaced along its length. The apertures 101 preferably include reinforcement grommets for added strength. A conventional heavy duty buckle 102 is also provided to maintain the work-belt 100 about a user's waist as is well known with belts. An optional pair of suspenders 103 can be provided to further support the work-belt 100 when the work-belt 100 supports a large number of pouches or pouches containing heavy tools and/or supplies. The suspenders 103 are attached to four of the apertures 101 on the work-belt 100 using clips, or the ends of the suspenders may be tied to the apertures or attached directly to the belt.

Each of the basic pouches 120, 120' and 120" include two hooks 121 for engaging two of the apertures 101 to thereby support the pouches 120 on the work-belt 100. The spacing of the apertures 101 on the work-belt 100, is such that the hooks 121 on the basic pouches 120 are inserted into two adjacent apertures 101 for support. The pouches 120, 120' and 120" themselves are made of a high strength material such as leather or strong pliable plastic that is folded over itself and sealed along the side edges to form the pocket 122 of the pouches 120, 120' and 120". Although the sides can be sealed or bonded using adhesive only, when leather, canvas, or other cloth type materials are used, reinforcement stitching may be substituted for the adhesive, or provided in addition to the adhesive, to increase the strength of the pouches 120, 120' and 120".

Hooks 121 are formed of heavy duty metal and may be sewn or glued to the back top edge of the pouches, as is known in the art. While hooks 121 are shown as simple loops, they may be in the form of a locking type clip (not shown) to insure that the hooks remain in the apertures. At the bottom of the pouches 120, 120' and 120" two apertures 123, which preferably include reinforcement grommets, are spaced apart the same distance as hooks 121. In this manner, the topmost pouch 120 of the pouches is attached directly to work-belt 100 by placing the two hooks 121 in two adjacent apertures 101. The next pouch 120' is then attached to pouch 120 by placing its two hooks 121 into the two apertures 123 provided in tab 124 formed at the bottom of pouch 120. It will be seen that tab 124 is outside and below the compartment of its associated pouch 120'. Still another basic pouch 120" can be attached to pouch 120' by placing its hooks 121 into the bottom apertures 123 of pouch 120'. Pouches 120, 120', 120" are thus in vertically stacked relationship, one immediately below or above the next. This can be repeated several times as described above.

Figure 2:
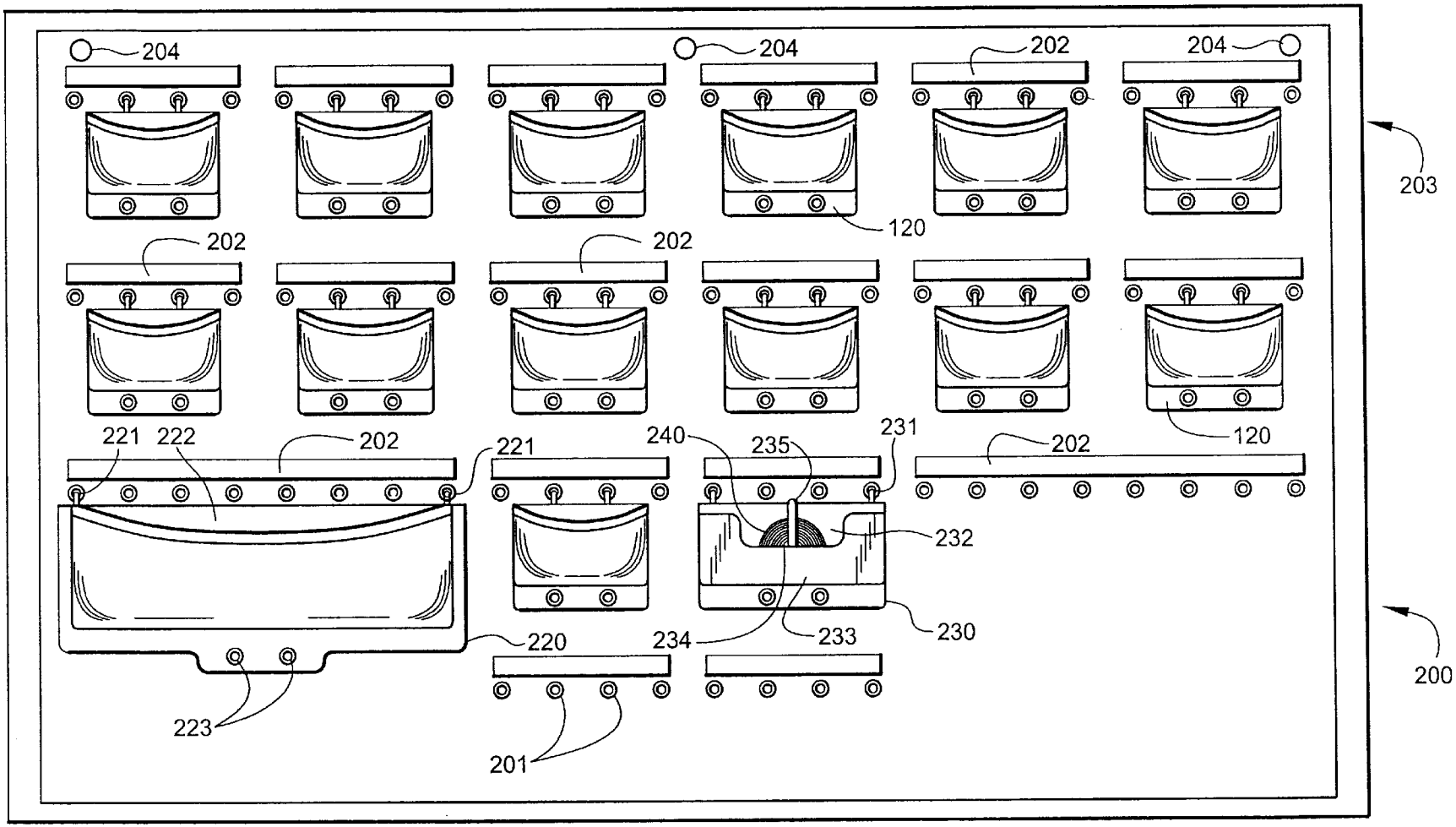
FIG. 2 is a front elevational view of the pouch storage unit of the combined work-belt and tool storage system of the present invention, showing several basic pouches, a large pouch and a tape pouch mounted on the pouch storage unit.
Figure 3:
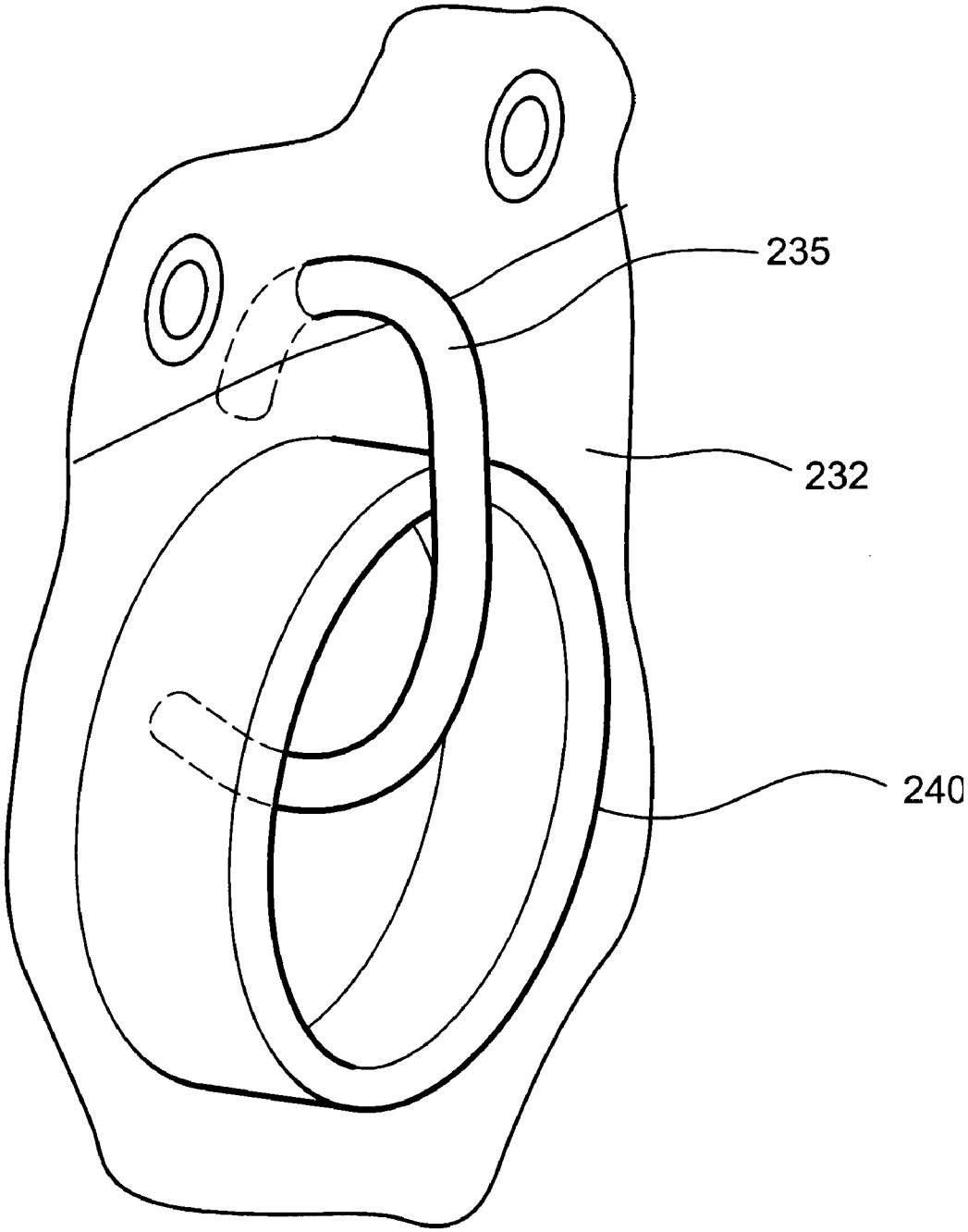
FIG. 3 is a detail view of a pouch shown at the lower center of FIG. 2.

An example of an organizing pouch storage unit of the present invention is shown as 200 in FIG. 2. The storage unit 200 contains a plurality of apertures 201 for supporting the hooks of the pouches. Each pouch has a specific storage location on the unit that includes indicia 202 that lists the contents of the pouch normally stored at that location. The storage unit 200 is provided in two basic embodiments, both of which are illustrated by FIG. 2. The first embodiment is a rigid storage and display board that could simply be made of peg-board having apertures substantially covering the board, or custom apertures could be drilled in a board to match the spacing of the hooks. The board is mounted in a convenient location for access to the pouches, and may include a frame 203 for protecting the edge of the board and/or for mounting purposes. In a second embodiment, the storage unit 200 is a flexible, pouch storage unit made of canvas or similar flexible material. The flexible storage unit can be unrolled on a flat surface to select and return pouches, or could be hung on a wall. Three holes 204 are provided for hanging the storage unit on wall hangers. After use, the flexible, pouch storage unit can be rolled up for storing and transporting.

FIG. 2 also illustrates two types of pouches in addition to the basic pouch 120. The large pouch 220 is similar in construction to the basic pouch 120, being approximately two times wider and slightly deeper, to provide a much larger pocket 222 for carrying large hardware (brackets, large construction nuts and bolts, etc.) or small hand tools. Hooks 221 are formed of heavy duty metal as in the basic pouch, however, hooks 221 are spaced further apart. While the actual size of the large pouch 220 can be varied, in the embodiment shown the hooks 221 engage every eighth aperture 201 on the storage unit 200, or 101 on the work-belt 100. The bottom of the large pouch 220 also has two apertures 223 with reinforcement grommets. Apertures 223 are preferably spaced apart the same distance as hooks 121 on the basic pouch 120. A basic pouch 120 can thereby be attached to the bottom of the large pouch by placing hooks 121 in apertures 223. It follows then that spacing apart of aperatures 201 of storage unit 200 is equal to that of aperatures 101 of work-belt 100. This is also seen by examining and comparing FIGS. 1 and 2. Should the large pouch 220 be intended for holding lightweight materials or tools, the apertures 223 may be spaced further apart for consecutive attachment of large pouches to each other.

A tape pouch 230 is also provided for supporting a roll of tape (electrical, duct, adhesive, etc.) or an encased tape measure, on the work-belt 100 or the storage unit 200. The tape pouch is similar in size and shape to the basic pouch, and includes two hooks 231 attached to the top of the back 232 of the pouch 230. A cut-out section 234 in the front 233 of the pouch 230 accommodates a double hook 235 that loops over the top edge of the rear 232 of the pouch 230 and through the center of the roll of tape 240, to further secure the roll of tape 240 within the pouch. When an encased measuring tape is stored in the pouch 230, the double hook 235 is not used, and the cut-out section 234 aids in removing the encased measuring tape from the pouch. (in which case the double hook would not be used). The two hooks 231 on the tape pouch 230 are shown spaced further apart than on the basic pouch 120, although the spacing can be the same for attachment of the tape pouch 230 to a basic pouch 120. Along the same vein, tape pouch 230 may include two apertures at the bottom thereof for consecutive attachment of a pouch to the tape pouch 230.

Other alterations and optional features include providing additional sets of apertures above the bottom apertures on each pouch. This provides for successive attachment of the pouches in a shorter arrangement. Furthermore, the pouches may be provided with flaps for holding the contents within.

It is to be understood that the present invention is not limited to the embodiments described above, but encompasses any and all embodiments within the scope of the following claims.

I claim:

1. A combined work-belt and tool storage system comprising:

a work-belt having a length, said work-belt including a first plurality of apertures spaced along its length;

an organizing pouch storage unit, said pouch storage unit including a second plurality of apertures spaced therealong at intervals similar to those of said first plurality of apertures of said work-belt, and a plurality of storage locations; and at least two pouches, said at least two pouches each having an open top, a closed bottom, a front, a back, two closed sides, a tab depending therefrom at a location outside and below a compartment of said pouch, two apertures through said tab, two hooks proximate and extending above said top, wherein spacing apart the of said two hooks and spacing the apart of said two apertures on each respective pouch are of equal distances; wherein a first pouch of said at least two pouches is selectively attachable to said work-belt and to said organizing pouch storage unit by placing said hooks of said first pouch selectively in two apertures of one of said first plurality of apertures of said work-belt or said second plurality of apertures of said organizing pouch storage unit; and a second pouch of said at least two pouches is selectively attachable to said first pouch in a location vertically below said first pouch by placing said hooks of said second pouch in said apertures of said first pouch, and said hooks of said first pouch being located below and outside of the compartment of said first pouch when said second pouch is attached to said first pouch.

2. The combined work-belt and tool storage system according to claim 1, wherein:

said pouch storage unit further includes a plurality of labels; and each label of said plurality of labels is associated with and mounted above each storage location of said plurality of storage locations, to thereby indicate the contents of any of said at least two pouches that is stored at each storage location.

3. The combined work-belt and tool storage system according to claim 1, wherein said pouch storage unit is a rigid storage and display board.

4. The combined work-belt and tool storage system according to claim 3, wherein said rigid storage and display board includes at least one hole for hanging said display board on a wall.

5. The combined work-belt and tool storage system according to claim 3, wherein said rigid storage and display board includes a frame thereabout.

6. The combined work-belt and tool storage system according to claim 1, wherein each said aperture of said first plurality of apertures includes a grommet.

7. The combined work-belt and tool storage system according to claim 1, wherein said work-belt further includes a pair of suspenders for supporting said work-belt on a user.

8. The combined work-belt and tool storage system according to claim 7, wherein said pair of suspenders are attached to said work-belt using four apertures of said first plurality of apertures.

9. The combined work-belt and tool storage system according to claim 1, wherein:

said first pouch is larger in size than said second pouch;

said hooks of said first pouch are spaced apart a first distance;

said hooks of said second pouch are spaced apart a second distance, said second distance being shorter than said first distance; and said apertures of said first pouch are spaced apart a third distance, said third distance being equal to said second distance such that said hooks of said second pouch can be placed in said apertures of said first pouch.

10. The combined work-belt and tool storage system according to claim 1, further comprising a tape pouch for selectively holding one of an enclosed tape measure and a roll of tape in addition to said at least two pouches, said tape pouch being dimensioned and configured to hold the enclosed tape measure or roll of tape, said tape pouch including:

an open top;

a closed bottom;

an open front with a cut-out section;

a back;

two closed sides; and two hooks proximate said top for attaching said tape pouch to one of said work-belt or said organizing pouch storage unit by placing said hooks of said tape pouch in two apertures of one of said first or second plurality of apertures.

11. The combined work-belt and tool storage system according to claim 10, wherein said tape pouch further includes a double hook wherein one end is looped over said back of said tape pouch and a second end is adapted to go through the center of a roll of tape, to thereby secure the roll of tape in said tape pouch.

* * * * *